US006933816B2

(12) United States Patent
Freeman

(10) Patent No.: US 6,933,816 B2
(45) Date of Patent: Aug. 23, 2005

(54) RELAY

(75) Inventor: James A. Freeman, Loveland, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/941,352

(22) Filed: Sep. 14, 2004

(65) Prior Publication Data

US 2005/0030135 A1 Feb. 10, 2005

Related U.S. Application Data

(60) Division of application No. 10/028,254, filed on Dec. 20, 2001, now Pat. No. 6,853,273, which is a continuation-in-part of application No. 09/841,928, filed on Apr. 24, 2001, now Pat. No. 6,621,391.

(51) Int. Cl.[7] ..... H01H 51/22
(52) U.S. Cl. ..... 335/78; 335/80
(58) Field of Search ..... 335/4–5, 76–78, 335/105, 124, 128; 333/81 R, 104–105

(56) References Cited

U.S. PATENT DOCUMENTS

| | | | | |
|---|---|---|---|---|
| 3,019,402 A | | 1/1962 | Lanctot | |
| 3,319,194 A | | 5/1967 | Adam | |
| 3,626,352 A | | 12/1971 | McCoig | |
| 3,753,170 A | | 8/1973 | Holland | |
| 3,828,286 A | | 8/1974 | Bain | |
| 4,008,447 A | | 2/1977 | Anderson et al. | |
| 4,019,165 A | | 4/1977 | Wright | |
| 4,021,631 A | | 5/1977 | Sprando | |
| 4,260,965 A | | 4/1981 | Nakamura et al. | |
| 4,475,095 A | | 10/1984 | Brown | |
| 4,496,919 A | | 1/1985 | Fournier et al. | |
| 4,595,893 A | | 6/1986 | Charbonnier et al. | |
| 4,795,960 A | | 1/1989 | Malcolm | |
| 4,949,061 A | | 8/1990 | Kirma | |
| 5,061,909 A | | 10/1991 | Hjipieris et al. | |
| 5,315,273 A | | 5/1994 | Blair et al. | |
| 5,894,255 A | * | 4/1999 | Wallintin | 335/80 |
| 6,211,756 B1 | | 4/2001 | Sun et al. | |
| 6,621,391 B2 | | 9/2003 | Freeman | |
| 6,853,273 B2 | * | 2/2005 | Freeman | 335/4 |

OTHER PUBLICATIONS

"RF & Microwave Test Accessories: Coaxial Step Attenuators" Hewlett–Packard Journal, Internet URL www.hp-.com/go/tmc98, 3 pages, 1998.

* cited by examiner

*Primary Examiner*—Lincoln Donovan
*Assistant Examiner*—Bernard Rojas

(57) ABSTRACT

In one embodiment, a method for reducing signal noise in a relay having pass-through and attenuator circuits which are alternately closed by operation of an armature assembly of the relay is disclosed. In accordance with the method, the armature assembly is provided with a grounding portion. The grounding portion of the armature assembly is oriented to make contact with the pass-through circuit when the attenuator circuit is closed, but not when the pass-through circuit is closed.

2 Claims, 5 Drawing Sheets

RELAY

CROSS-REFERENCE TO RELATED APPLICATIONS

This is a divisional of application Ser. No. 10/028,254 filed on Dec. 20, 2001 now U.S. Pat. No. 6,853,273, which was a continuation-in-part of then application Ser. No. 09/841,928 filed on Apr. 24, 2001 (now U.S. Pat. No. 6,621,391). This application and patent are hereby incorporated by reference for all that they disclose.

BACKGROUND

One way to close a circuit connection is by way of an electro-mechanical relay. In its simplest form, a relay merely makes or breaks a single circuit connection (i.e., it opens or closes a path through which current may flow). Depending on the relay's intended use, a biased conductor which makes the circuit connection is biased so that the connection is "normally open" or "normally closed". An armature which is movable between first and second positions then presses on the biased conductor when the armature is moved to one of its positions, and the pressing on the biased conductor causes the biased conductor to move from its biased state. In this manner, a normally open connection may be closed, and a normally closed connection may be opened. Movement of the armature is controlled by an electro-magnetic actuator assembly. Typically, the actuator assembly will comprise a magnetic core encircled by an electric coil. The ends of the coil are coupled to a control circuit. When the control circuit is closed, current flows through the coil and causes the magnetic core to exert an attractive or repelling force which causes a relay's armature to move out of its biased position. When the control circuit is opened, current ceases to flow through the coil and the magnetic force exerted by the core ceases to exist. Opening the control circuit therefore allows a relay's armature to return to its biased position. While the movement of an armature is typically rotational (e.g., the armature is mounted within a relay using pins which lie on the armature's rotational axis), the movement of an armature is sometimes translational (e.g., the armature is mounted so that it travels along a track).

While some simple relays comprise only a single circuit, and therefore a single current path which may be opened or closed, other relays comprise two or more circuits through which current may alternately flow, depending on which of the two or more circuits is currently closed. In some relays, two alternate circuit paths will comprise a pass-through circuit path and an attenuated circuit path. The pass-through circuit path simply allows electrical signals to flow through the relay without attenuation. On the other hand, and as its name implies, the attenuated circuit path attenuates electrical signals which flow through the relay.

With advances in manufacturing technology, electronic devices have become increasingly smaller. As a result, the size of electro-mechanical relays has decreased. However, as pass-through and attenuator circuits are mounted in closer proximity of one another, there is a greater chance that the two circuits will interfere with one another. For example, an electrical signal flowing through an attenuator circuit may receive unwanted attenuation from an open pass-through circuit or vice versa. The open circuit acts as an antenna which receives stray electrical signals and then capacitively transfers the stray signals to the closed circuit. Because this interference may increase as the distance separating the relevant circuits decreases, reducing this interference to a manageable level has become an increasingly important design criterion for miniature relays.

An example of a typical electro-mechanical relay comprising pass-through and attenuator circuits, which is hereby incorporated by reference for all that it discloses, is disclosed in the U.S. Patent of Blair et al. entitled "Attenuator Relay" (U.S. Pat. No. 5,315,273). The relay disclosed by Blair et al. is intended to be housed in a cannister having a volume of approximately 0.05 cubic inches. While such a miniature relay is adequate for some applications, the close proximity of its pass-through and attenuator circuits results in too much noise in other applications.

SUMMARY OF THE INVENTION

In one embodiment, a method for reducing signal noise in a relay having pass-through and attenuator circuits which are alternately closed by operation of an armature assembly of the relay is disclosed. In accordance with the method, the armature assembly is provided with a grounding portion. The grounding portion of the armature assembly is oriented to make contact with the pass-through circuit when the attenuator circuit is closed, but not when the pass-through circuit is closed.

BRIEF DESCRIPTION OF THE DRAWINGS

Illustrative and presently preferred embodiments of the invention are illustrated in the drawings, in which.

DETAILED DESCRIPTION OF AN EMBODIMENT

1. In General

Figure 1:
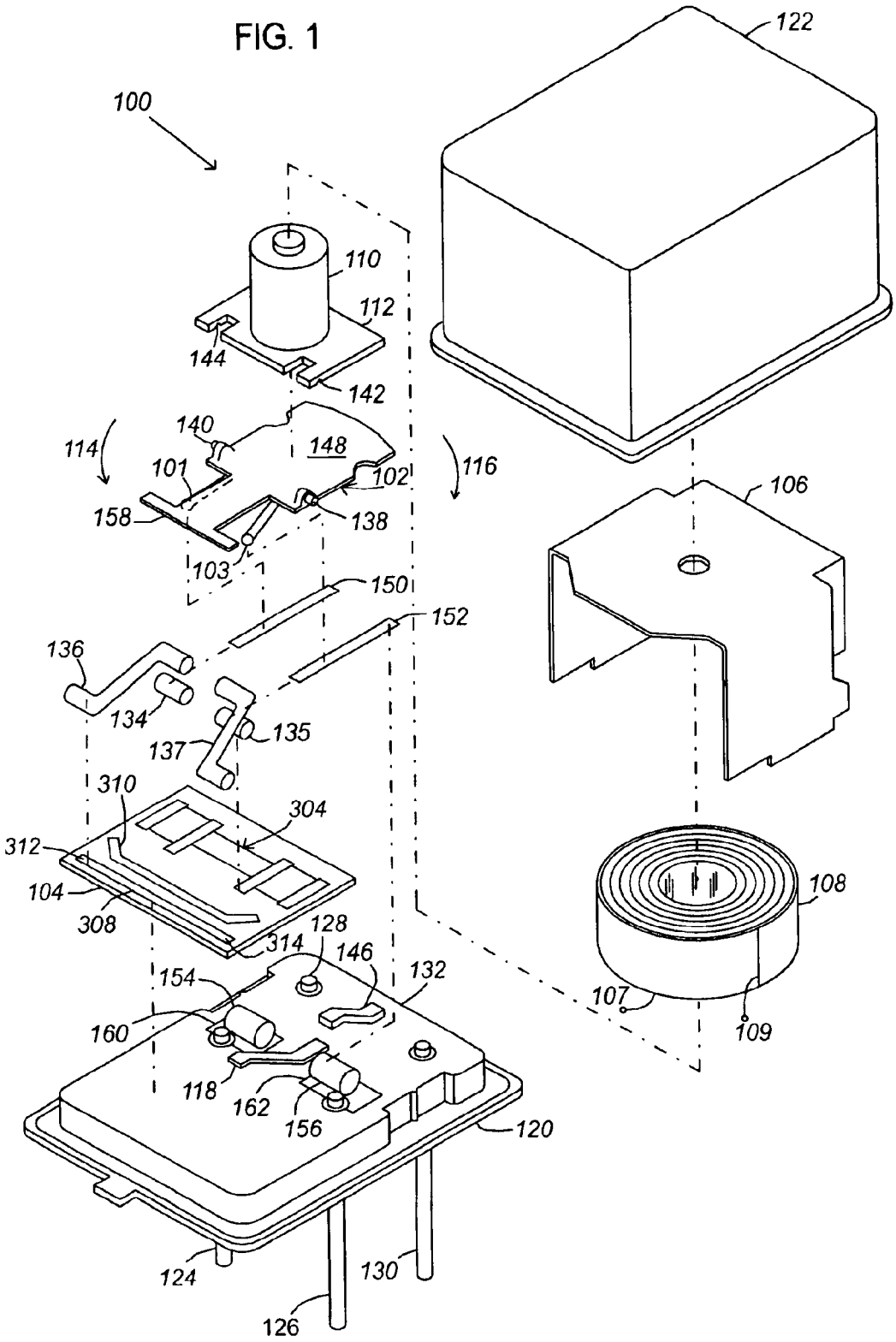
FIG. 1 is an exploded, perspective view of a first relay embodiment.
Figure 5:
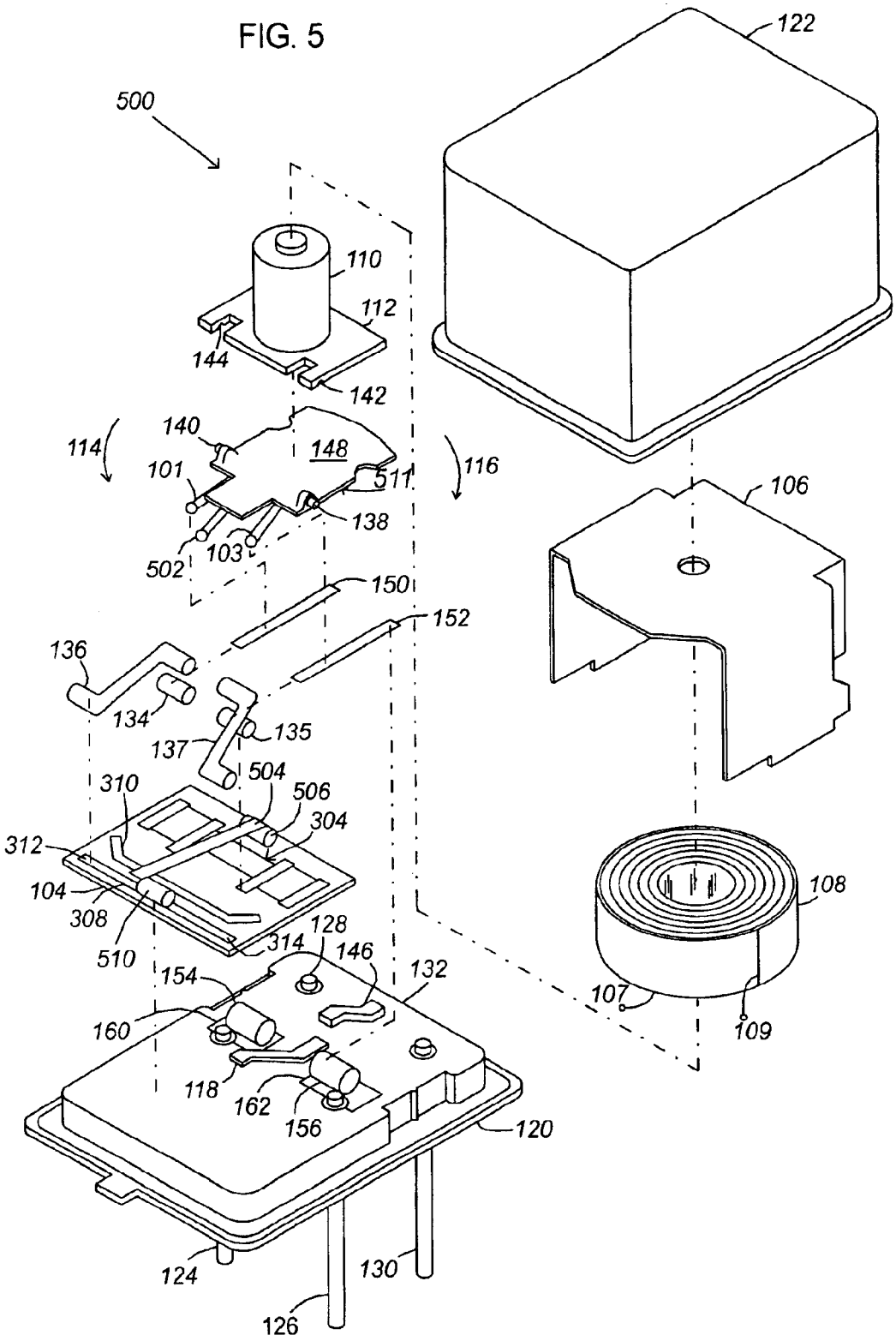
FIG. 5 is an exploded, perspective view of a third relay embodiment.

FIGS. 1 and 5 respectively illustrate first and second embodiments 100, 500 of a relay. Common to both embodiments 100, 500 is an armature assembly 102, 511 (or some other means) which is movable between first and second positions with respect to first 302 and second 304 circuits. See FIGS. 3 & 7. By way of example, each of the relay embodiments 100, 500 shown herein shows the first circuit 302 to be a pass-through circuit and shows the second circuit 304 to be an attenuator circuit.

Figure 4:
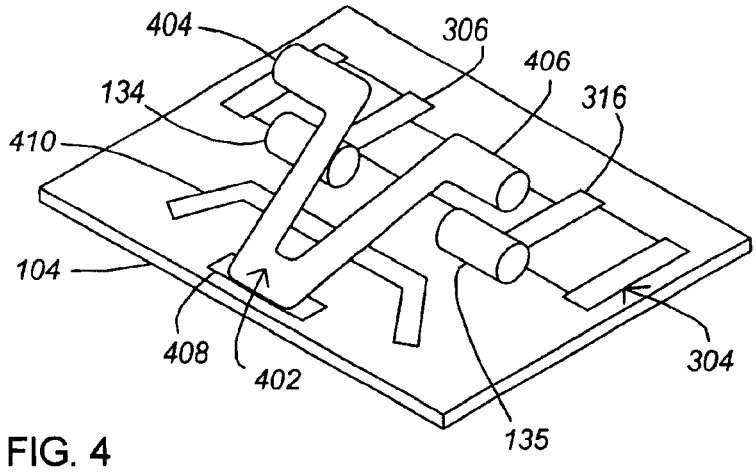
FIG. 4 is a perspective view of an alternate arrangement of elements mounted on the FIG. 1 substrate.

As shown in FIGS. 1 & 4, when the armature assembly 102, 511 of one of the relays is moved to its first position, current is allowed to flow through the relay's first circuit 302. Likewise, when the armature assembly 102, 511 of one of the relays is moved to its second position, current is allowed to flow through the relay's second circuit 304. In this manner, the first and second circuits 302, 304, are alternately closed to allow current flow therethrough.

A relay's armature assembly 102, 511 may be mounted for either rotational (pivotal) or translational (up/down or side/side) movement. However, by way of example, the armature assemblies in FIGS. 1 and 5 are shown to be mounted for rotational movement.

In each of FIGS. 1 and 5, an electromagnetic actuator assembly 106, 108, 110, 112 provides the force or forces which are needed to move an armature assembly 102, 511 between its first and second positions. The electromagnetic actuator assembly 106–112 may be more or less integrated with the structure of an armature assembly 102, 511, and FIGS. 1 and 4 only show one preferred embodiment of an electromagnetic actuator assembly 106–112. In the preferred embodiment of the electromagnetic actuator assembly 106–112, the assembly's application or withdrawal of a single, attractive magnetic force provides for armature assembly movement. For example, refer to FIG. 1 wherein the electromagnetic actuator assembly 106–112 comprises a core 110 and coil 108 which are mounted between two magnetic poles 106, 112. When a voltage is applied to the ends 107, 109 of the coil 108, the core 110 causes a magnetic field to be formed between the two magnetic poles 106, 112, and thereby causes an attractive magnetic force to be exerted on one end of the armature assembly 102, thereby causing the armature assembly 102 to rotate in a first direction 114 (i.e., counter-clockwise in FIG. 1). When the voltage is withdrawn from the coil 108, the magnetic field formed between the two magnetic poles 106, 112 dissipates, and a biasing spring 118 returns the armature assembly 102 to its first position (i.e., the armature assembly 102 moves in direction 116).

Other means of moving an armature assembly 102 will be readily apparent to those skilled in the art. For example, an electromagnetic actuator assembly could be designed to alternately attract and repel one end of an armature assembly 102 (e.g., in response to two different voltages which are applied to the electromagnetic actuator assembly). An electro-magnetic actuator assembly could also take the form of a solenoid, wherein a plunger pushes and/or pulls one end of an armature assembly 102.

Each of the relay embodiments 100, 500 shown herein also comprises a means 158, 504 for grounding the first circuit 302 while the second circuit 304 is closed. In this manner, little if any signal noise is transferred from the first circuit 302 to the second circuit 304 while the second circuit 304 is in use.

Having briefly discussed some of the features which are common to the relay embodiments 100, 500 illustrated in FIGS. 1 and 5, each of the relays 100, 500 will now be described in greater detail.

2. A First Relay Embodiment

FIG. 1 illustrates a first embodiment 100 of a relay. The relay 100 is housed within a metallic structure comprising a base plate 120 and a cover 122. Protruding through the base plate 120 are first and second pairs of conductive terminals 124/126, 128/130, each pair of which is insulated from the metallic base plate 120. The conductive terminals 124, 126 of the first pair are signal terminals, and are alternately coupled to one another via first and second circuits 302, 304 (FIG. 3) which are housed within the relay 100. The conductive terminals 128, 130 of the second pair are control terminals, and are provided for the purpose of controlling an electro-magnetic actuator assembly 106–112 which is housed within the relay 100. The presence of a voltage on the control terminals 128, 130 determines the state of the electro-magnetic actuator assembly 106–112, which in turn determines which of the two circuits 302, 304 mounted within the relay 100 will be connected between the signal terminals 124, 126.

A header 132 is mounted (e.g., welded) within the relay housing 120, 122 on top of the base plate 120. The header 132 serves to give the relay 100 more rigidity, and is preferably formed of a metallic material which is grounded to the relay housing 120, 122. By way of example, the header 132 may comprise gold plated Kovar.

The four conductive terminals 124–130 protrude through the header 132, and into the interior of the relay housing 120, 122. The terminals 124-130 are insulated from the header 132, preferably by glass beads which form a glass to metal seal between each terminal 124–130 and the Kovar header 132.

Figure 2:
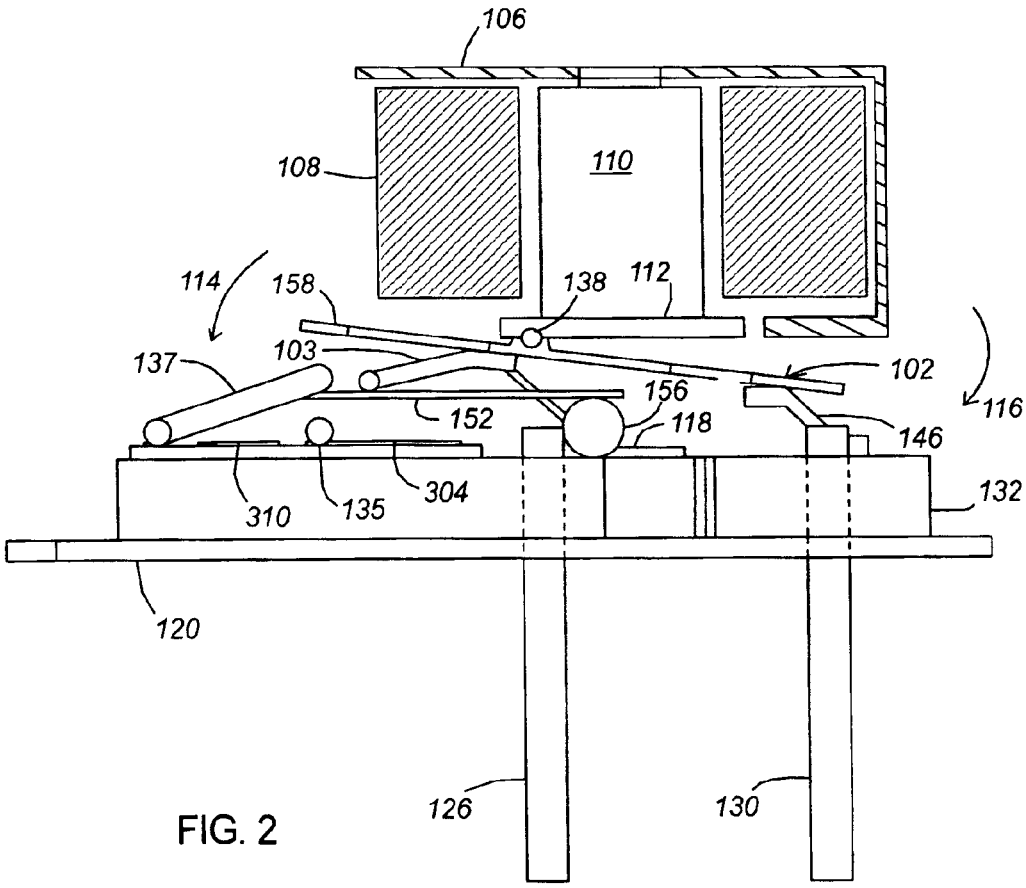
FIG. 2 is an assembled, elevational view of the internal components of the FIG. 1 relay.

A substrate 104 (such as a lapped alumina ($Al_2O_3$) ceramic substrate) is mounted to the header 132 (FIGS. 1, 3), in front of the signal terminals 124, 126 (as seen in FIG. 2).

Figure 3:
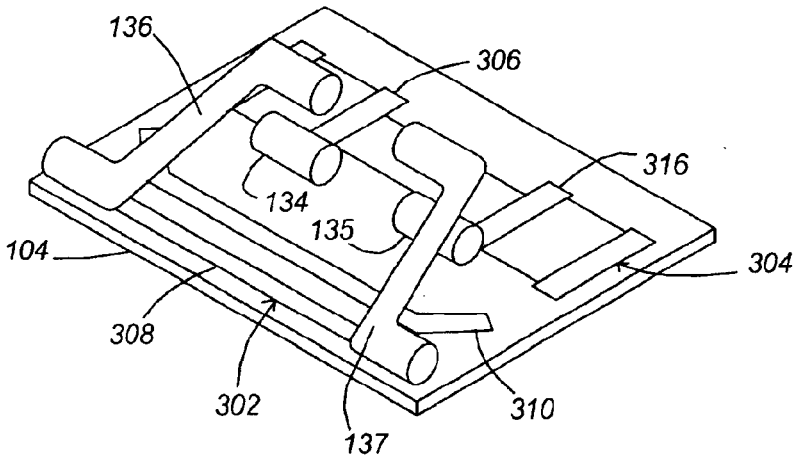
FIG. 3 is a perspective view of the FIG. 1 substrate, wherein the orientation of elements mounted thereon is shown.

First and second circuits 302, 304 are mounted to the top face of the substrate 104 (FIG. 3). In one embodiment, the first and second circuits 302, 304 are, respectively, pass-through and attenuator circuits. The attenuator circuit 304 comprises a pair of contacts 134, 135 that provide a means for coupling the attenuator circuit 304 between the relay's two signal terminals 124, 126. As shown in FIG. 1, each of these contacts 134, 135 may take the form of a metallic cylinder. Similarly to the attenuator circuit 304, the pass-through circuit 302 comprises a pair of contacts 136, 137 that provide a means for coupling the pass-through circuit 302 between the relay's two signal terminals 124, 126. As shown in FIG. 1, each of the pass-through circuit's contacts 136, 137 may take the form of an elongated, metallic cylinder shaped, in general, as a "straightened S curve" (see FIG. 3). Ends of the pass-through circuit's contacts 136, 137 are positioned above respective ones of the attenuator circuit's contacts 134, 135. In this manner, small gaps are formed between respective pass-through and attenuator circuit contacts 134/136, 135/137.

As can be seen in FIGS. 1 & 2, an additional pair of contacts 154, 156 is coupled to the relay's signal terminals 124, 126 (FIG. 2). The contacts 154, 156 are electrically insulated from the header 132 by, for example, areas 160, 162 of the Kovar header 132 which are left unplated (FIG. 1). Respectively coupled to this additional pair of contacts 154, 156 is a pair of leaf springs 150, 152. The free ends of the leaf springs 150, 152 extend into the gaps formed between the respective ones of the pass-through and attenuator circuit contacts 134/136, 135/137 (FIGS. 2 and 3). The leaf springs 150, 152 are biased so that their free ends rest against respective ones of the pass-through circuit contacts 136, 137. Thus, while at rest, the leaf springs 150, 152 allow current to flow from one to the other of the relay's signal terminals 124, 126 via the pass-through circuit 302. When an armature assembly 102 (to be described) applies downward pressure to the leaf springs 150, 152, the leaf springs 150, 152 break electrical contact with the pass-through circuit's contacts 136, 137 and are forced to make electrical contact with the attenuator circuit's contacts 134, 135. In this position, the leaf springs 150, 152 allow current to flow from one to the other of the relay's signal terminals 124, 126 via the attenuator circuit 304.

The electromagnetic actuator assembly 106–112 which is mounted within the relay housing 120, 122 comprises two magnetic poles 106, 112, a coil 108, and a core 110. The coil 108 is slipped over the core 110, and the core 110 and coil 108 are then mounted between the two magnetic poles 106, 112. The first magnetic pole 106 is then used to mount the electromagnetic actuator assembly 106–112 to the header 132 such that the second magnetic pole 112 is suspended over the header 132 and in back of the afore-mentioned substrate 104. The two ends 107, 109 of the coil 108 are respectively and electrically coupled to the relay's control terminals 128, 130. When a voltage is applied to the control terminals 128, 130, current flows through the coil 108 and an electromagnetic force flows through the core 110. The electromagnetic force in turn polarizes the two magnetic poles 106, 112 and causes the lower portion of the first magnetic pole to exert an attractive magnetic force on one end of the relay's armature assembly 102.

The armature assembly 102 comprises a main body 148, a number of actuator arms 101, 103, and a grounding portion (e.g., the extension 158 illustrated in FIG. 1). In FIG. 1, one of the actuator arms 101 is partially hidden by the armature assembly 102. The hidden portion of this actuator arm 101 is therefore depicted by broken lines. The main body 148 of the armature assembly 102 is an essentially flat structure to which the number of actuator arms 101, 103, the extension 158, and two pivot pins 138, 140 are attached. The extension 158 is conductive and grounded. Preferably, the extension 158 is integrated with the main body 148 of the armature assembly 102 and is grounded by virtue of the main body 148 being grounded (as will be described in more detail below). The actuator arms 101, 103 are preferably formed of a strong, non-conductive material such as plastic. The pivot pins 138, 140 may fit into indents 142, 144, holes or crevices formed in the underside of the second magnetic pole 112.

A biasing spring 118 is mounted on the header 132. The biasing spring 118 applies pressure to the underside of the armature assembly 102 so that the armature assembly 102 assumes its first position when the electromagnetic actuator assembly 106–112 is not energized (see FIG. 2). A stop 146 is also mounted on the header 132. The stop 146 prevents the spring 118 from over-biasing the armature assembly 102. Other means of biasing the armature assembly 102 are contemplated, but not preferred. For example, the electromagnetic actuator assembly 106–112 could bias the armature assembly 102 to its first position by repelling it, and then move the armature assembly 102 to its second position by attracting it. Or for example, the armature assembly 102 could be biased to its first position via an unequal weight distribution.

The biasing spring 118 may be grounded by virtue of its being welded to the gold plated header 132. If the main body 148 and extension 158 of the armature assembly 102 are electrically coupled and metallic (e.g., if they main body 148 and extension 158 are cut from a single sheet of metal), then the armature assembly's extension 158 may be coupled to ground by virtue of the spring 118 pressing against the main body 148 of the armature assembly 102.

Although the armature assembly's extension 158 may be grounded as described in the preceding paragraph, the armature assembly's extension 158 may also be grounded in other ways. For example, the extension 158 may be grounded by virtue of the armature assembly 102 having metallic pivot pins 138, 140 that make contact with the second magnetic pole 112, or the extension 158 may be grounded by means of a wire that couples the armature assembly 102 (or just the extension 158) to ground (not shown).

The actuator arms 101, 103 which extend from the armature assembly 102 are positioned over the afore-mentioned pair of leaf springs 150, 152. When the armature assembly 102 is at rest in its first position (i.e., when no voltage is applied to the electromagnetic actuator assembly 106–112), the actuator arms 101, 103 apply no pressure to the leaf springs 150, 152, and the pass-through circuit 302 is coupled between the relay's signal terminals 124, 126. However, when a voltage is applied to the electro-magnetic actuator assembly 106–112 (i.e., via the relay's control terminals 128, 130), the armature assembly 102 moves to its second position, and the actuator arms 101, 103 apply downward pressure to the leaf springs 150, 152. In this position, the leaf springs 150, 152 are forced to make electrical contact with the attenuator circuit's contacts 134, 135, and the attenuator circuit 304 is coupled between the relay's signal terminals 124, 126.

When the armature assembly 102 is moved to its second position, the armature assembly's extension 158 is oriented such that it presses against and grounds the pass-through circuit (i.e., movement of the armature assembly 102 to its second position couples the pass-through circuit 302 to ground). In one embodiment, the extension 158 is generally T-shaped, with opposite upper ends that are oriented to contact opposite ends of the pass-through circuit 302 (e.g., ends of the "straightened S curve" contacts 136, 137) when the armature assembly 102 is moved to its second position.

Having described the various elements of the relay 100 as a whole, the circuits 302, 304 and other elements which are mounted to the substrate 104 will now be described in further detail. See FIG. 3.

A first element which is mounted to the substrate 104 is the pass-through circuit 302. The pass-through circuit 302 preferably comprises a stripline 308 or micro-strip for much of its run, thereby enabling the pass-through circuit 302 to behave as a transmission line. Each end of the stripline 308 terminates in a weld area 312, 314 (FIG. 1) to which a contact 136, 137 shaped as a "straightened S curve" is welded. The contacts 136, 137 are oriented such that the ends of the contacts 136, 137 which are not welded to the stripline 308 are suspended over a pair of contacts 134, 135 which form part of the attenuator circuit 304.

Figure 8:
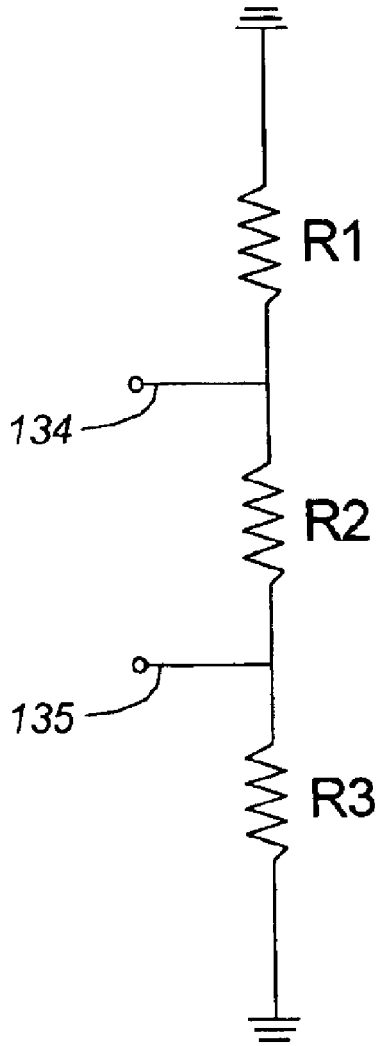
FIG. 8 is a plan view of one configuration for the attenuator circuit shown in FIGS. 4, 5 & 7.

A second element which is mounted to the substrate 104 is the attenuator circuit 304. The attenuator circuit 304 may assume any of a number of configurations (e.g., a "TT" network (FIG. 8), a "T" network, or an "L" network). Precise values and types of components which form a part of the attenuator circuit 304 are beyond the scope of this disclosure, and may be chosen to suit a particular application. However, an exemplary attenuator circuit configuration is illustrated in FIG. 8. Note that the exemplary configuration is a "TT" configuration comprising resistors R1, R2 and R3. The attenuator circuit 304 may comprise either a lumped resistance network or distributed resistance network, as applications merit. However, a distributed resistance is preferred in that it provides a better field distribution and results in smaller signal reflections.

Each of the afore-mentioned attenuator circuit configurations is coupled into a larger circuit via two connections. In FIG. 3, these connections are represented by two weld areas 306, 316 to which contacts 134, 135 shaped as metallic cylinders are welded.

For better RF performance, it is generally preferred that the electrical lengths and propagation delays of the pass-through and attenuator circuits 302, 304 be equal (or at least substantially matched). It is also preferable to minimize the size of the cylindrical contacts. In this manner, problems associated with signal reflection may be greatly reduced.

The stripline 308 referenced in the preceding paragraphs may be, for example, a 50 ohm line with Ni/Co/Au plated ends (e.g., hard gold>=225 knoop hardness). The weld areas 306, 312, 314, 316 may be formed, for example, via a plating process using NiPd with a Au flash, or hard Au (e.g., Ni/Co/Au≧225 knoop hardness). The stripline 308, ground 310 weld areas 306, 312, 314, 316 and attenuator circuit resistors (R1, R2, R3) may be mounted to the substrate 104 by gluing, masking, and/or other means (e.g., etching or plating).

Preferably, and to further enable the transmission line behavior of the pass-through circuit 302, at least some portion of the relay's ground should present on the substrate 104 to form a dividing line 310 between the pass-through and attenuator circuits 302, 304. By way of example, the ground 310 may be formed of gold, and may be coupled to other relay grounds by virtue of various means, one of which is a conductive via formed in the substrate 104 for the purpose of coupling the ground 310 to the header's plating. Alternately (or additionally), the ground 310 could be coupled to metallized sides of the substrate 104. The metallized sides of the substrate 104 could then be coupled to the plated header 132.

One advantage of the relay 100 shown in FIGS. 1–3 is that grounding of the pass-through circuit 302 while the attenuator circuit 304 is in use helps to keep interference between the two circuits 302, 304 (i.e., signal noise) below a manageable level. A problem with past relays having two circuit paths is that the unused circuit tended to act as an antenna for noise, which noise was then imparted to the circuit path which was in use. The FIG. 1 relay 100 eliminates or at least significantly reduces this phenomenon.

3. A Second Relay Embodiment

FIG. 4 illustrates an alternate arrangement of elements mounted on the FIG. 1 substrate 104. In FIG. 4, an attenuator circuit 304 including cylindrical, metallic contacts 134, 135 is mounted to a substrate 104 as shown in FIG. 3. However, the makeup of the pass-through circuit 402 is changed.

In FIG. 4, the pass-through circuit 402 comprises a substantially V shaped metallic cylinder. The base of the V shaped metallic cylinder 402 is welded to a weld area 408 mounted on the substrate 104. Opposite ends 404, 406 of the metallic cylinder 402 are suspended over the attenuator circuit's contacts 134, 135.

A second relay embodiment may be formed by substituting the FIG. 4 substrate 104 and circuits 402, 304 for the substrate 104 and circuit 302, 304 illustrated in FIGS. 1 & 3. In doing so, the pass-through and attenuator circuits 402, 304 shown in FIG. 4 may be alternately coupled between the FIG. 1 relay's signal terminals 124, 126 using the same armature assembly 102, leaf springs 150, 152 and other relay elements illustrated in FIG. 1.

Preferably, a ground 410 mounted on the substrate 104 still separates the pass-through and attenuator circuits 402, 304. Furthermore, when the FIG. 1 relay's armature assembly 102 assumes its second position, the armature assembly's extension 158 contacts the ends 404, 406 of the pass-through circuit 402 so as to ground the pass-through circuit 402.

An advantageous of the FIG. 4 pass-through circuit 402 is that the stubs existing in the FIG. 3 pass-through circuit (i.e., by virtue of welding the contacts 136, 137 to the stripline 308) are eliminated. As a result, fewer signal reflections are generated by the FIG. 4 pass-through circuit 402.

4. A Third Relay Embodiment

FIG. 5 illustrates a third relay embodiment 500. Like the first relay 100, the third relay 500 is housed within a metallic structure comprising a base plate 120 and a cover 122. Protruding through the base plate 120 are first and second pairs of conductive terminals 124/126, 128/130, each pair of which is insulated from the metallic base plate 120. The conductive terminals 124, 126 of the first pair are signal terminals, and are alternately coupled to one another via first and second circuits 302, 304 (FIG. 7) which are housed within the relay 500. The conductive terminals 128, 130 of the second pair are control terminals, and are provided for the purpose of controlling an electro-magnetic actuator assembly 106–112 which is housed within the relay 500. The presence of a voltage on the control terminals 128, 130 determines the state of the electromagnetic actuator assembly 106–112, which in turn determines which of the two circuits 302, 304 mounted within the relay 500 will be connected between the signal terminals 124, 126.

A header 132 is mounted (e.g., welded) within the relay housing 120, 122 on top of the base plate 120. The header 132 serves to give the relay 500 more rigidity, and is preferably formed of a metallic material which is grounded to the relay housing 120, 122. By way of example, the header 132 may comprise gold plated Kovar.

The four conductive terminals 124–130 protrude through the header 132, and into the interior of the relay housing 120, 122. The terminals 124–130 are insulated from the header 132, preferably by glass beads which form a glass to metal seal between each terminal 124–130 and the Kovar header 132.

A substrate 104 (such as a lapped alumina ($Al_2O_3$) ceramic substrate) is mounted to the header 132 (FIGS. 1, 3), in front of the signal terminals 124, 126 (as seen in FIG. 2).

Figure 7:
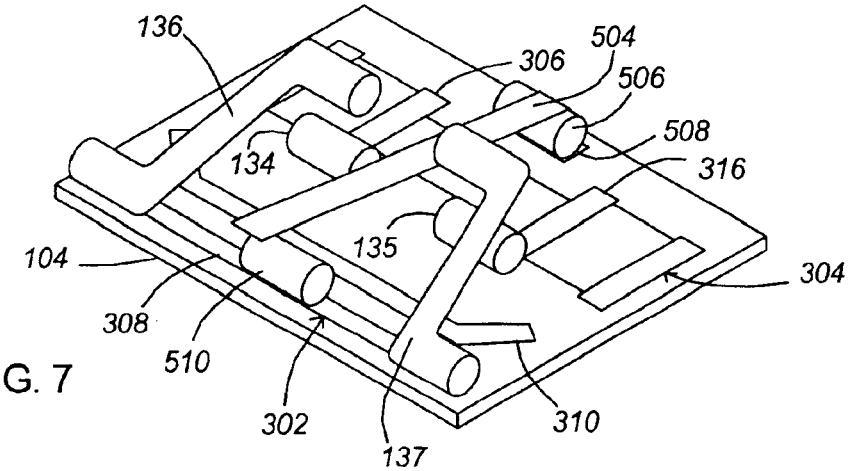
FIG. 7 is a perspective view of the FIG. 5 substrate, wherein the orientation of elements mounted thereon is shown.

First and second circuits 302, 304 are mounted to the top face of the substrate 104 (FIG. 7). In one embodiment, the first and second circuits 302, 304 are, respectively, pass-through and attenuator circuits. The attenuator circuit 304 comprises a pair of contacts 134, 135 that provide a means for coupling the attenuator circuit 304 between the relay's two signal terminals 124, 126. As shown in FIG. 5, each of these contacts 134, 135 may take the form of a metallic cylinder. Similarly to the attenuator circuit 304, the pass-through circuit 302 comprises a pair of contacts 136, 137 that provide a means for coupling the pass-through circuit 302 between the relay's two signal terminals 124, 126. As shown in FIG. 5, each of the pass-through circuit's contacts 136, 137 may take the form of an elongated, metallic cylinder shaped, in general, as a "straightened S curve" (see FIG. 7). Ends of the pass-through circuit's contacts 136, 137 are positioned above respective ones of the attenuator circuit's contacts 134, 135. In this manner, small gaps are formed between respective pass-through and attenuator circuit contacts 134/136, 135/137.

As can be seen in FIG. 5, an additional pair of contacts 154, 156 is coupled to the relay's signal terminals 124, 126 (FIG. 5). The contacts 154, 156 are electrically insulated from the header 132 by, for example, areas 160, 162 of the Kovar header 132 which are left unplated (FIG. 5). Respectively coupled to this additional pair of contacts 154, 156 is a pair of leaf springs 150, 152. The free ends of the leaf springs 150, 152 extend into the gaps formed between the respective ones of the pass-through and attenuator circuit contacts 134/136, 135/137 (FIG. 7). The leaf springs 150, 152 are biased so that their free ends rest against respective ones of the pass-through circuit contacts 136, 137. Thus, while at rest, the leaf springs 150, 152 allow current to flow from one to the other of the relay's signal terminals 124, 126 via the pass-through circuit 302. When an armature assembly 511 (to be described) applies downward pressure to the leaf springs 150, 152, the leaf springs 150, 152 break electrical contact with the pass-through circuit's contacts 136, 137 and are forced to make electrical contact with the attenuator circuit's contacts 134, 135. In this position, the leaf springs 150, 152 allow current to flow from one to the other of the relay's signal terminals 124, 126 via the attenuator circuit 304.

The electro-magnetic actuator assembly 106–112 which is mounted within the relay housing 120, 122 comprises two magnetic poles 106, 112, a coil 108, and a core 110. The coil 108 is slipped over the core 110, and the core 110 and coil 108 are then mounted between the two magnetic poles 106, 112. The first magnetic pole 106 is then used to mount the electro-magnetic actuator assembly 106–112 to the header 132 such that the second magnetic pole 112 is suspended over the header 132 and in back of the afore-mentioned substrate 104. The two ends 107, 109 of the coil 108 are respectively and electrically coupled to the relay's control terminals 128, 130. When a voltage is applied to the control terminals 128, 130, current flows through the coil 108 and an electromagnetic force flows through the core 110. The electromagnetic force in turn polarizes the two magnetic poles 106, 112 and causes the lower portion of the first magnetic pole to exert an attractive magnetic force on one end of the relay's armature assembly 511.

Figure 6:
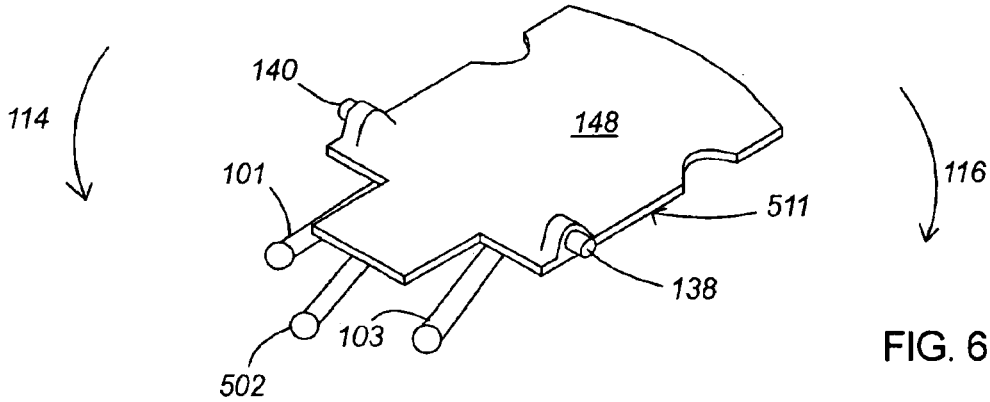
FIG. 6 is a perspective view of the FIG. 5 armature assembly.

The armature assembly 511 comprises a main body 148 and a number of actuator arms 101, 103, 502 (FIGS. 5 & 6). The main body 148 of the armature assembly 511 is an essentially flat structure to which the number of actuator arms 101, 103, 502 and two pivot pins 138, 140 are attached. The actuator arms 101, 103, 502 are preferably formed of a strong, non-conductive material such as plastic. The pivot pins 138, 140 may fit into indents 142, 144, holes or crevices formed in the underside of the second magnetic pole 112.

A biasing spring 118 is mounted on the header 132. The biasing spring 118 applies pressure to the underside of the armature assembly 511 so that the armature assembly 511 assumes its first position when the electro-magnetic actuator assembly 106–112 is not energized. A stop 146 is also mounted on the header 132. The stop 146 prevents the spring 118 from over-biasing the armature assembly 511. Other means of biasing the armature assembly 511 are contemplated, but not preferred. For example, the electro-magnetic actuator assembly 106–112 could bias the armature assembly 511 to its first position by repelling it, and then move the armature assembly 511 to its second position by attracting it. Or for example, the armature assembly 511 could be biased to its first position via an unequal weight distribution.

Two of the actuator arms 101, 103 which extend from the armature assembly 511 are positioned over the afore-mentioned pair of leaf springs 150, 152. When the armature assembly 511 is at rest in its first position (i.e., when no voltage is applied to the electro-magnetic actuator assembly 106–112), the actuator arms 101, 103 apply no pressure to the leaf springs 150, 152, and the pass-through circuit 302 is coupled between the relay's signal terminals 124, 126. However, when a voltage is applied to the electro-magnetic actuator assembly 106–112 (i.e., via the relay's control terminals 128, 130), the armature assembly 511 moves to its second position, and the actuator arms 101, 103 apply downward pressure to the leaf springs 150, 152. In this position, the leaf springs 150, 152 are forced to make electrical contact with the attenuator circuit's contacts 134, 135, and the attenuator circuit 304 is coupled between the relay's signal terminals 124, 126.

The third of the actuator arms 502 is positioned over a biased conductor (such as a third leaf spring 504). This third leaf spring 504 is coupled (e.g., welded) to a cylindrical, metallic contact 506 which is, in turn, welded to a pad 508 formed on the substrate 104. The pad 508 is coupled to ground (as will be described in greater detail below). The opposite end of the leaf spring is suspended over an additional cylindrical, metallic contact 510. This additional contact 510 is welded to the pass-through circuit 302. When the armature assembly 511 is at rest, the third leaf spring 504 is biased not to couple the pass-through circuit 302 to ground (i.e., the leaf spring 504 is biased in a "disconnect" position). However, as the armature assembly 511 moves to its second position, the third actuator arm 502 presses on the third leaf spring 504 and causes the leaf spring 504 to couple the pass-through circuit 302 to ground.

Having described the various elements of the relay 100 as a whole, the circuits 302, 304 and other elements which are mounted to the substrate 104 will now be described in further detail. See FIG. 7.

A first element which is mounted to the substrate 104 is the pass-through circuit 302. The pass-through circuit 302 preferably comprises a stripline 308 or micro-strip for much of its run, thereby enabling the pass-through circuit 302 to behave as a transmission line. Each end of the stripline 308 terminates in a weld area 312, 314 (FIG. 5) to which a contact 136, 137 shaped as a "straightened S curve" is welded. The contacts 136, 137 are oriented such that the ends of the contacts 136, 137 which are not welded to the stripline 308 are suspended over a pair of contacts 134, 135 which form part of the attenuator circuit 304. An additional contact 510 is welded to the pass-through circuit 510 for the purpose of grounding the pass-through circuit 302 when it is not in use.

A second element which is mounted to the substrate 104 is the attenuator circuit 304. The attenuator circuit 304 may assume any of a number of configurations (e.g., a "TT" network (FIG. 8), a "T" network, or an "L" network). Precise values and types of components which form a part of the attenuator circuit 304 are beyond the scope of this disclosure, and may be chosen to suit a particular application. However, an exemplary attenuator circuit configuration is illustrated in FIG. 8. Note that the exemplary configuration is a "TT" configuration comprising resistors R1, R2 and R3. The attenuator circuit 304 may comprise either a lumped resistance network or distributed resistance network, as applications merit. However, a distributed resistance is preferred in that it provides a better field distribution and results in smaller signal reflections.

Each of the afore-mentioned attenuator circuit configurations is coupled into a larger circuit via two connections. In FIG. 7, these connections are represented by two weld areas 306, 316 to which contacts 134, 135 shaped as metallic cylinders are welded.

A third element which is mounted to the substrate 104 is the third leaf spring 504 (i.e., the leaf spring that is used to ground the pass-through circuit 302 when it is not in use). This third leaf spring 504 is welded to a cylindrical, metallic contact 506 which is, in turn, welded to a pad 508 formed on the substrate 104. The pad 508 is coupled to ground. Preferably, the pad 508 is coupled to ground by virtue of a via in the substrate 104 that couples the pad 508 to plated header 134, or by virtue of coupling the pad 508 to metallized sides of the substrate 104 (which are in turn coupled to the plated header 132).

For better RF performance, it is generally preferred that the electrical lengths and propagation delays of the pass-through and attenuator circuits 302, 304 be equal (or at least substantially matched). It is also preferable to minimize the size of the cylindrical contacts. In this manner, problems associated with signal reflection may be greatly reduced.

The stripline 308 referenced in the preceding paragraphs may be, for example, a 50 ohm line with Ni/Co/Au plated ends (e.g., hard gold>=225 knoop hardness). The weld areas 306, 312, 314, 316, 508 may be formed, for example, via a plating process using NiPd with a Au flash, or hard Au (e.g., Ni/Co/Au≧225 knoop hardness). The stripline 308, ground 310 weld areas 306, 312, 314, 316 and attenuator circuit resistors (R1, R2, R3) may be mounted to the substrate 104 by gluing, masking, and/or other means (e.g., etching or plating).

Preferably, and to further enable the transmission line behavior of the pass-through circuit 302, at least some portion of the relay's ground should present on the substrate 104 to form a dividing line 310 between the pass-through and attenuator circuits 302, 304. By way of example, the ground 310 may be formed of gold, and may be coupled to other relay grounds by virtue of various means, one of which is a conductive via formed in the substrate 104 for the purpose of coupling the ground 310 to the header's plating. Alternately (or additionally), the ground 310 could be coupled to metallized sides of the substrate 104. The metallized sides of the substrate 104 could then be coupled to the plated header 132.

One advantage of the relay 100 shown in FIGS. 1–3 is that grounding of the pass-through circuit 302 while the attenuator circuit 304 is in use helps to keep interference between the two circuits 302, 304 (i.e., signal noise) below a manageable level. A problem with past relays having two circuit paths is that the unused circuit tended to act as an antenna for noise, which noise was then imparted to the circuit path which was in use. The FIG. 1 relay 100 eliminates or at least significantly reduces this phenomenon.

5. Alternate Relay Embodiments

The relays disclosed in FIGS. 1, 4 and 5 may be alternately embodied and constructed, without departing from the principles disclosed herein.

As previously mentioned, an armature assembly 102, 511 need not move in a pivotal fashion, and could alternately move in a translational fashion.

Furthermore, the first and second circuits need not be pass-through and attenuator circuits. Any combination of two circuits which one might alternately desire to couple into a circuit path could benefit from the principles disclosed herein.

While preferred materials of construction have been disclosed in some instances, a variety of insulating and conductive materials may be used to form the various components of the relays illustrated in FIGS. 1, 4 and 5.

While illustrative and presently preferred embodiments of the invention have been described in detail herein, it is to be understood that the inventive concepts may be variously embodied and employed, and that the appended claims are intended to be construed to include such variations, except as limited by the prior art.

What is claimed is:

1. A relay, comprising:

a) a first circuit;

b) a second circuit;

c) a ground;

d) an electro-magnetic actuator assembly; and e) an armature assembly which is movable between first and second positions with respect to the first and second circuits, the armature assembly comprising an extension that is coupled to ground, wherein:

i) armature assembly movement is controlled by the electro-magnetic actuator assembly;

ii) movement of the armature assembly to its first position allows current to flow through the first circuit; and iii) movement of the armature assembly to its second position allows current to flow through the second circuit, and moves the extension into contact with the first circuit to thereby couple the first circuit to ground.

2. A relay as in claim 1, wherein:

a) the extension is generally T-shaped; and b) opposite upper ends of the T-shaped extension contact opposite ends of the first circuit when the armature assembly is moved to its second position.

* * * * *